US008612220B2

(12) United States Patent
Mouhssine et al.

(10) Patent No.: US 8,612,220 B2
(45) Date of Patent: Dec. 17, 2013

(54) QUANTIZATION AFTER LINEAR TRANSFORMATION COMBINING THE AUDIO SIGNALS OF A SOUND SCENE, AND RELATED CODER

(75) Inventors: Adil Mouhssine, Rennes (FR); Abdellatif Benjelloun Touimi, London (GB); Pierre Duhamel, Le Plessis-Robinson (FR)

(73) Assignee: France Telecom, Paris (FR)

( * ) Notice: Subject to any disclaimer, the term of this patent is extended or adjusted under 35 U.S.C. 154(b) by 1023 days.

(21) Appl. No.: 12/667,401

(22) PCT Filed: Jul. 1, 2008

(86) PCT No.: PCT/FR2008/051220

§ 371 (c)(1),
(2), (4) Date: Dec. 31, 2009

(87) PCT Pub. No.: WO2009/007639

PCT Pub. Date: Jan. 15, 2009

(65) Prior Publication Data

US 2010/0198585 A1 Aug. 5, 2010

(30) Foreign Application Priority Data

Jul. 3, 2007 (FR) ..... 07 04794

(51) Int. Cl.
*G10L 19/00* (2013.01)

(52) U.S. Cl.
USPC ..... 704/230; 704/200.1; 704/203

(58) Field of Classification Search
USPC ..... 704/219, 229, 230, 200, 203, 200.1, 704/500–504
See application file for complete search history.

(56) References Cited

U.S. PATENT DOCUMENTS 6,021,386 A * 2/2000 Davis et al. ..... 704/229
7,548,853 B2 * 6/2009 Shmunk et al. ..... 704/219

OTHER PUBLICATIONS

Derrien et al., "On the Interplay between Audio Compression and Spatialization: Bit-Rate Reduction without Quality Damage," 2001 IEEE Fourth Workshop on Multimedia Signal Processing, Oct. 3-4, 2001, Piscataway, NJ, USA, IEEE, pp. 313-318 (Oct. 3, 2001).
Derrien et al., "Une approche statistique pour l'optimisation du MPEG-2/4 AAC (Advanced Audio Coder) en mode stéréophonique matricé (MS stéréo)," Actes de Colloques du Groupe D'Etudes du Traitement du Signal et des Images (GRETSI), pp. 1-4 (2003).
Daniel, "Représentation de champs acoustiques, application à la transmission et à la reproduction de scènes sonores complexes dans un contexte multimédia," Thèse de doctorat de l'Université Paris 6, pp. 1-319 (Jul. 31, 2001).
Gerson, "Hierarchical Transmission of Multispeaker Stereo," IEEE Applications of Signal Processing to Audio and Acoustics, pp. 133-134 (Oct. 20, 1991).
Meyer et al., "A highly scalable spherical microphone array based on an orthonormal decomposition of the soundfield," ICASSP, IEEE International Conference on Acoustics, Speech and Signal Processing—Proceedings, vol. 2, pp. II/1784-II/1784—Abstract (2002).

* cited by examiner

*Primary Examiner* — Huyen X. Vo
(74) *Attorney, Agent, or Firm* — Drinker Biddle & Reath LLP

(57) ABSTRACT

The invention relates to a method for quantifying components, wherein certain components are each determined based on a plurality of audio signals and can be calculated by the application of a linear conversion on the audio signals, said method comprising: determining a quantification function to be applied to the components by testing a condition relative to an audio signal and depending on a comparison made between a psycho-acoustic masking threshold relative to the audio signal and a value determined based on the reverse linear conversion and quantification errors of the components by the function.

10 Claims, 2 Drawing Sheets

QUANTIZATION AFTER LINEAR TRANSFORMATION COMBINING THE AUDIO SIGNALS OF A SOUND SCENE, AND RELATED CODER

CROSS-REFERENCE TO RELATED APPLICATIONS

This application is the U.S. national phase of the International Patent Application No. PCT/FR2008/051220 filed Jul. 1, 2008, which claims the benefit of French Application No. 07 04794 filed Jul. 3, 2007, the entire content of which is incorporated herein by reference.

BACKGROUND

The present invention relates to devices for coding audio signals, intended especially to be deployed in applications concerning the transmission or storage of digitized and compressed audio signals.

The invention pertains more precisely to the quantization modules included in these audio coding devices.

The invention relates more particularly to 3D sound scene coding. A 3D sound scene, also called surround sound, comprises a plurality of audio channels each corresponding to monophonic signals.

A technique for coding signals of a sound scene used in the "MPEG Audio Surround" coder (cf. "Text of ISO/IEC FDIS 23003-1, MPEG Surround", ISO/IEC JTC1/SC29/WG11 N8324, Jul. 2006, Klagenfurt, Austria), comprises the extraction and coding of spatial parameters on the basis of the whole set of monophonic audio signals on the various channels. These signals are thereafter mixed to obtain a monophonic or stereophonic signal, which is then compressed by a conventional mono or stereo coder (for example of the MPEG-4 AAC, HE-AAC type, etc). At the decoder level, the synthesis of the reconstructed 3D sound scene is done on the basis of the spatial parameters and the decoded mono or stereo signal.

The coding of the multichannel signals requires in certain cases the introduction of a transformation (KLT, Ambisonic, DCT, etc.) making it possible to take better account of the interactions which may exist between the various signals of the sound scene to be coded.

It is always necessary to increase the audio quality of the sound scenes reconstructed after a coding and decoding operation.

SUMMARY

In accordance with a first aspect, the invention proposes a method for quantizing components, some at least of these components being each determined as a function of a plurality of audio signals of a sound scene and computable by applying a linear transformation to said audio signals.

According to the method, a quantization function to be applied to said components in a given frequency band is determined by testing a condition relating to at least one audio signal and depending at least on a comparison performed between a psychoacoustic masking threshold relating to the audio signal in the given frequency band, and a value determined as a function of the inverse linear transformation and of errors of quantization of the components by said function on the given frequency band.

Such a method therefore makes it possible to determine a quantization function which makes it possible to mask, in the reconstruction listening domain, the noise introduced with respect to the audio signal of the initial sound scene. The sound scene reconstructed after the coding and decoding operations therefore exhibits better audio quality.

Indeed, the introduction of a multichannel transform (for example of ambisonic type) transforms the real signals into a new domain different from the listening domain. The quantization of the components resulting from this transform according to the prior art procedures, based on a perceptual criterion (i.e. complying with the masking threshold for said components), does not guarantee minimum distortion on the real signals reconstructed in the listening domain. Indeed, the computation of the quantization function according to the invention makes it possible to guarantee that the quantization noise induced on the real signals by the quantization of the transformed components is minimal in the sense of a perceptual criterion. The condition of a maximum improvement in the perceptual quality of the signals in the listening domain is then satisfied.

In one embodiment the condition relates to several audio signals and depends on several comparisons, each comparison being performed between a psychoacoustic masking threshold relating to a respective audio signal in the given frequency band, and a value determined as a function of the inverse linear transformation and of errors of quantization of the components by said function.

This provision further increases the audio quality of the sound scene reconstructed.

In one embodiment, the determination of the quantization function is repeated during the updating of the values of the components to be quantized. This provision also makes it possible to increase the audio quality of the sound scene reconstructed, by adapting the quantization over time as a function of the characteristics of the signals.

In one embodiment, the condition relating to an audio signal at least is tested by comparing the psychoacoustic masking threshold relating to the audio signal and an element representing the value $$\sum_{j=l}^{r}\left(h_{i,j}^{2}B_j(s)^{\frac{3}{2}}\mu_{1_{2,j}}(s)\right),$$

where s is the given frequency band, r is the number of components, $h_{i,j}$ is that coefficient of the inverse linear transform relating to the audio signal and to the $j^{th}$ component with j=1 to r, $B_j(s)$ represents a parameter of the quantization function in the band s relating to the $j^{th}$ component and $\mu_{1_{2,j}}(s)$ is the mathematical expectation in the band s of the square root of the $j^{th}$ component.

In one embodiment, a quantization function to be applied to said components in the given frequency band is determined with the aid of an iterative process generating at each iteration a parameter of the candidate quantization function satisfying the condition and associated with a corresponding bit rate, the iteration being halted when the bit rate is below a given threshold.

Such a provision thus makes it possible to simply determine a quantization function on the basis of the determined parameters, allowing the masking of the noise in the reconstruction listening domain while reducing the coding bit rate below a given threshold.

In one embodiment, the linear transformation is an ambisonic transformation.

In a particular embodiment, the linear transformation is an ambisonic transformation. This provision makes it possible on the one hand to reduce the number of data to be transmitted since, in general, the N signals can be described in a very satisfactory manner by a reduced number of ambisonic components (for example, a number equal to 3 or 5), less than N. This provision furthermore allows adaptability of the coding to any type of sound rendition system, since at the decoder level, it suffices to apply an inverse ambisonic transform of size Q'x(2p'+1), (where Q' is equal to the number of loudspeakers of the sound rendition system used at the output of the decoder and 2p'+1 the number of ambisonic components received), to determine the signals to be provided to the sound rendition system.

The invention can be implemented with any linear transformation, for example the DCT or else the KLT ("Karhunen Loeve Transform") transform which corresponds to a decomposition over principal components in a space representing the statistics of the signals and makes it possible to distinguish the highest-energy components from the lowest-energy components.

In accordance with a second aspect, the invention proposes a quantization module adapted for quantizing components, some at least of these components each being determined as a function of a plurality of audio signals of a sound scene and computable by applying a linear transformation to said audio signals, said quantization module being adapted for implementing the steps of a method in accordance with the first aspect of the invention.

In accordance with a third aspect, the invention proposes an audio coder adapted for coding an audio scene comprising several respective signals as a binary output stream, comprising:

a transformation module adapted for computing by applying a linear transformation to said audio signals, components at least some of which are each determined as a function of a plurality of the audio signals of a sound scene; and a quantization module in accordance with the second aspect of the invention adapted for determining at least one quantization function on at least one given frequency band and for quantizing the components on the given frequency band as a function of at least the determined quantization function;

the audio coder being adapted for constructing a binary stream as a function at least of quantization data delivered by the quantization module.

In accordance with a fourth aspect, the invention proposes a computer program to be installed in a quantization module, said program comprising instructions for implementing the steps of a method in accordance with the first aspect of the invention during execution of the program by processing means of said module.

In accordance with a fifth aspect, the invention proposes coded data, determined following the implementation of a quantization method in accordance with the first aspect of the invention.

BRIEF DESCRIPTION OF THE DRAWINGS

Other characteristics and advantages of the invention will be further apparent on reading the description which follows. The latter is purely illustrative and should be read in relation with the appended drawings in which.

DETAILED DESCRIPTION OF PREFERRED EMBODIMENTS

Figure 1:
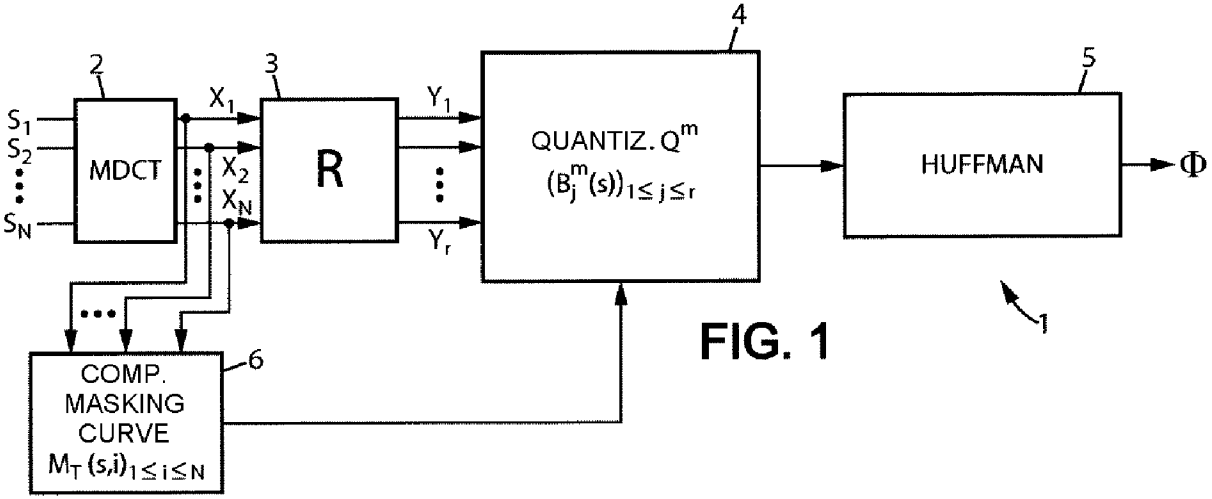
FIG. 1 represents a coder in an embodiment of the invention.

FIG. 1 represents an audio coder 1 in an embodiment of the invention. It relies on the technology of perceptual audio coders, for example of MPEG-4 AAC type.

The coder 1 comprises a time/frequency transformation module 2, a linear transformation module 3, a quantization module 4, a Huffman entropy coding module 5 and a masking curve computation module 6, with a view to the transmission of a binary stream Φ representing the signals provided as input to the coder 1.

A 3D sound scene comprises N channels on each a respective audio signal $S_1, \ldots, S_N$ is delivered.

Figure 2:
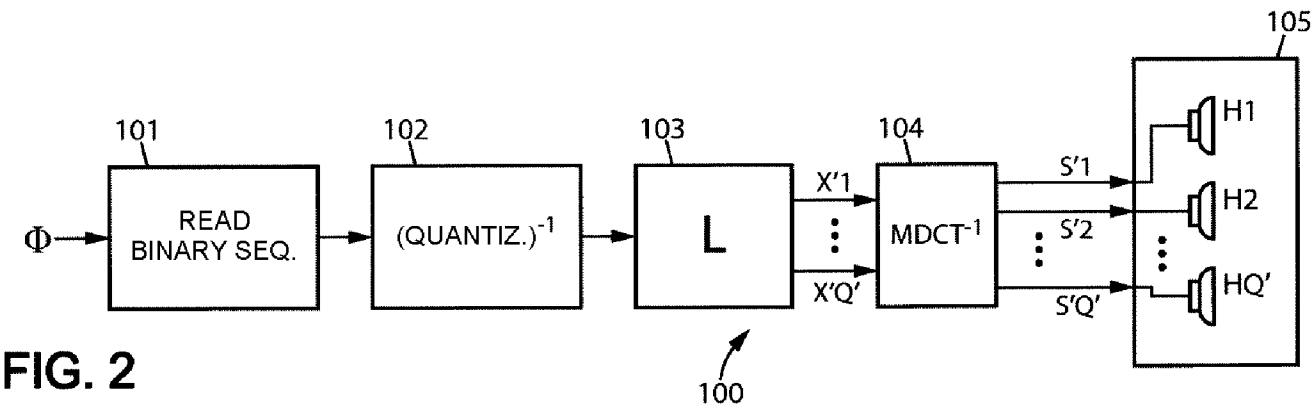
FIG. 2 represents a decoder in an embodiment of the invention.

FIG. 2 represents an audio decoder 100 in an embodiment of the invention.

The decoder 100 comprises a binary sequence reading module 101, an inverse quantization module 102, an inverse linear transformation module 103, a frequency/time transformation module 104.

The decoder 100 is adapted for receiving as input the binary stream Φ transmitted by the coder 1 and for delivering as output Q' signals $S'_1, \ldots, S'_{Q'}$ intended to supply the Q' respective loudspeakers H1, H2 . . . , HQ' of a sound rendition system 105.

Operations Carried Out at the Coder Level:

The time/frequency transformation module 2 of the coder 1 receives as input the N signals $S_1, \ldots, S_N$ of the 3D sound scene to be coded, in the form of successive blocks.

Each block m received comprises N temporal frames each indicating various values taken in the course of time by a respective signal.

On each temporal frame of each of the signals, the time/frequency transformation module 2 performs a time/frequency transformation, in the present case, a modified discrete cosine transform (MDCT).

Thus, following the reception of a new block comprising a new frame for each of the signals $S_i$, it determines, for each of the signals $S_i$, i=1 to N, its spectral representation $X_i$, characterized by M MDCT coefficients $X_{i,t}$, with t=0 to M−1. An MDCT coefficient $X_{i,t}$ thus represents the spectrum of the signal $S_i$ for a frequency $F_t$.

The spectral representations $X_i$ of the signals $S_i$, i=1 to N, are provided as input to the linear transformation module 3.

The spectral representations $X_i$ of the signals $S_i$, i=1 to N, are furthermore provided as input to the module 6 for computing the masking curves.

The coding of multichannel signals comprises in the case considered a linear transformation, making it possible to take into account the interactions between the various audio signals to be coded, before the monophonic coding, by the quantization module 4, of the components resulting from the linear transformation.

The linear transformation module 3 is adapted for performing a linear transformation of the coefficients of the spectral representations $(X_i)_{1 \le i \le N}$ provided. In one embodiment, it is adapted for performing a spatial transformation. It then determines the spatial components of the signals $(X_i)_{1 \le i \le N}$ in the frequency domain, resulting from the projection onto a spatial reference system depending on the order of the transformation. The order of a spatial transformation is tied to the angular frequency according to which it "scans" the sound field.

In the embodiment considered, the linear transformation module 3 performs an ambisonic transformation of order p (for example p=1), which gives a compact spatial representation of a 3D sound scene, by carrying out projections of the sound field onto the associated spherical or cylindrical harmonic functions.

For further information about ambisonic transformations, reference may be made to the following documents: "Représentation de champs acoustiques, application à la transmission et à la reproduction de scènes sonores complexes dans un contexte multimédia" [Representation of acoustic fields, application to the transmission and reproduction of complex sound scenes in a multimedia context], Doctoral Thesis from the University of Paris 6, Jérôme DANIEL, Jul. 31, 2001, "A highly scalable spherical microphone array based on an orthonormal decomposition of the sound field", Jens Meyer—Gary Elko, Vol. II—pp. 1781-1784 in Proc. ICASSP 2002.

The spatial transformation module 3 thus delivers r (r=2p+1) ambisonic components $(Y_j)_{1\le j\le r}$. Each ambisonic component $Y_j$ considered in the frequency domain comprises M spectral parameters $Y_{j,t}$ for t=0 to M−1. The spectral parameter $Y_{j,t}$ pertains to the frequency $F_t$ for t=0 to M−1.

The ambisonic components are determined in the following manner:

$$\begin{bmatrix} Y_{1,0} & \cdots & \cdots & Y_{1,M-1} & \\ \cdots & \cdots & \cdots & \cdots & \\ & & & & \cdots \\ \cdots & \cdots & \cdots & \cdots & \\ Y_{r,0} & \cdots & \cdots & Y_{r,M-1} & \end{bmatrix} = R \begin{bmatrix} X_{1,0} & \cdots & \cdots & X_{1,M-1} & \\ \cdots & \cdots & \cdots & \cdots & \\ & & & & \cdots \\ \cdots & \cdots & \cdots & \cdots & \\ X_{N,0} & \cdots & \cdots & X_{N,M-1} & \end{bmatrix}$$

where $$R = (R_{i,j})_{\substack{1\le i\le r \\ 1\le j\le N}}$$

is the ambisonic transformation matrix of order p for the spatial sound scene, with $$R_{1,j} = 1 R_{i,j} = \sqrt{2}\cos\left[\left(\frac{i}{2}\right)\theta_j\right]$$

if i even and $$R_{1,j} = \sqrt{2}\sin\left[\left(\frac{i-1}{2}\right)\theta_j\right]$$

if i odd greater than or equal to 3, and θj is the angle of propagation of the signal $S_j$ in the space of the 3D scene.

Each of the ambisonic components is therefore determined as a function of several signals $(S_i)_{1\le i\le N}$.

The masking curve computation module 6 is adapted for determining the spectral masking curve for each frame of a signal $X_i$ considered individually in the block m, with the aid of its spectral representation $X_i$ and of a psychoacoustic model.

The masking curve computation module 6 thus computes a masking threshold $M^m{}_T(s, i)$, relating to the frame of each signal $(S_i)^{1\le i\le N}$ in the block m, for each frequency band s considered during the quantization. Each frequency band s is element of a set of frequency bands comprising for example the bands such as standardized for the MPEG-4 AAC coder.

The masking thresholds $M^m{}_T(s, i)$ for each signal $S_i$ and each band of frequencies s are delivered to the quantization module 4.

The quantization module 4 is adapted for quantizing the components $(Y_j)_{1\le j\le r}$ which are provided to it as input, so as to reduce the bit rate required for transmission. Respective quantization functions are determined by the quantization module 4 on each frequency band s.

In an arbitrary band s, the quantization module 4 quantizes each spectral coefficient $(Y_{j,t})_{1\le j\le r_{0\le t\le M-1}}$ such that the frequency $F_t$ is element of the frequency band s. It thus determines a quantization index i(k) for each spectral coefficient $(Y_{j,t})_{1\le j\le r_{0\le t\le M-1}}$ such that the frequency $F_t$ is element of the frequency band s.

For a band s considered, k takes the values of the set $\{k_{min,s}, k_{min+1,s}, \ldots k_{max,s}\}$, and $(k_{max,s}-k_{min+1,s}+1)$ is equal to the number of spectral coefficients to be quantized in the band s for the set of ambisonic components.

The quantization function $Q^m$ applied by the quantization module 4 for the coefficients $$(Y_{j,t})_{\substack{1\le j\le r \\ 0\le t\le M-1}}$$

computed for a block m of signals takes the following form, in accordance with the MPEG-4 AAC standard:

$$Q^m(Y_{j,t}) = Arr\left(\left(\frac{Y_{j,t}}{B_j^m(S)}\right)^{\frac{3}{4}}\right)$$

with the frequency $F_t$ element of the frequency band s, and there exists k element of $\{k_{min,s}, k_{min+1,s}, \ldots k_{max,s}\}$ such that $Q^m\{Y_{j,t})=i(k)$.

$B_j{}^m(s)$, scale coefficient relating to the ambisonic component $Y_j$, takes discrete values. It depends on the relative integer scale parameter $\phi_j{}^m(s)$:

$$B_j^m(s) = 2^{\frac{1}{4}\varphi_j^m(s)}.$$

Arr is a rounding function delivering an integer value. Arr(x) is for example the function providing the integer nearest to the variable x, or else the "integer part" function of the variable x, etc.

The quantization module 4 is adapted for determining a quantization function to be applied to a frequency band s checking that the masking threshold $M^m{}_T(s, i)$ of each signal $S_i$ in the listening domain, with 1≤i≤N, is greater than the power of the error introduced, on an audio signal reconstructed in the listening domain corresponding to channel i (and not in the linear transformation domain), by the errors of quantization introduced into the ambisonic components.

The quantization module 4 is therefore adapted for determining, during the processing of a block m of signals, the quantization function defined with the aid of the scale parameters $(B_j{}^m(s))_{1\le j\le r}$ relating to each band s, such that, for every i, 1≤i≤N, the error introduced on the signal $S_i$ in the band s by the quantization of the ambisonic components is less than the masking threshold $M^m{}_T(s, i)$ of the signal $S_i$ on the band s.

A problem to be solved by the quantization module 4 is therefore to determine, on each band s, the set of scale coefficients $(B_j^m(s))_{1\le j\le r}$ satisfying the following formula (1):

$$\{B_j^m | P_e^m(s, i) \le M_T^m(s, i),\ 1 \le i \le N\}_{1\le j\le r}$$

where $P_e^m(s, i)$ is the error power introduced on the signal $S_i$ following the quantization errors introduced by the quantization, defined by the scale coefficients $(B_j^m(s))_{1\le j\le r}$, of the ambisonic components.

Thus, $B_j(s)$ represents a parameter characterizing the quantization function in the band s relating to the $j^{th}$ component. The choice of $B_j(s)$ determines in a bijective manner the quantization function used.

The effect of this provision is that the noise introduced in the listening domain by the quantization on the components arising from the linear transformation remains masked by the signal in the listening domain, thereby contributing to better quality of the signals reconstructed in the listening domain.

In one embodiment, the problem indicated above by formula (1) is translated into the form of the following formula (2):

$$\{B_j^m | \text{Probability}(P_e^m(s, i) \le M_T^m(s, i)) \ge \alpha,\ 1 \le i \le N\}_{1\le j\le r},$$

where $\alpha$ is a fixed degree of compliance with the masking threshold.

The probability is computed for the frame relating to the signal $S_i$ of the block m considered and over the whole set of frequency bands s.

The justification for this translation is made in the document "Optimisation de la quantification par modèles statistiques dans le codeur MPEG Advanced Audio coder (AAC)—Application à la spatialisation d'un signal comprimé en environnement MPEG-4" [Optimization of quantization by statistical models in the MPEG Advanced Audio coder (AAC)—Application to the spatialization of an MPEG-4 environment compressed signal], Doctoral Thesis by Olivier Derrien—ENST Paris, Nov. 22, 2002, hereinafter dubbed the "Derrien document". According to this document, one seeks to modify the quantization so as to decrease the distortion perceived by the ear of a signal resulting from an HRTF spatialization filtering ("Head Related Transfer Function") also referred to as a head filter modeling the effect of the propagation path between the position of the sound source and the human ear and taking into account the effect due to the head and to the torso of a listener, applied after the decoding.

Moreover, $$P_e^m(s, i) = \sum_{k=k_{min}}^{k=k_{max}} e_i^m(k)^2,$$

where $\{e_i^m(k)\}_{k_{min,s}\le k\le k_{max}}$ are the errors introduced on the $K_s = (k_{max,s} - k_{min+1,s} + 1)$ spectral coefficients of the signal $S_i$ corresponding to frequencies in the band s.

Let $$H = (h_{i,j})_{\substack{1\le i\le N\\ 1\le j\le r}}$$

be the matrix inverse of the ambisonic transformation matrix R, then $$e_i^m(k) = \sum_{j=1}^{j=r} h_{i,j} v_j^m(k)$$

where $\{v_j^m(k)\}_{k_{min,s}\le k\le k_{max}}$, are the quantization errors introduced on the $k_{max,s} - k_{min+1,s} + 1)$ spectral coefficients of ambisonic components corresponding to frequencies in the band s.

Thus $$P_e^m(s, i) = \sum_{k=k_{min,s}}^{k=k_{max,s}} \sum_{j=1}^{j=r} \left(\sum h_{i,j} v_j^m(k)\right)^2$$

The following assumptions are made:

- the quantization errors $e_i^m(k)$ are independent random variables equi-distributed according to the index k;
- the quantization errors $e_i^m(k)$ are random variables according to the index i;
- the number of samples in a band s is sufficiently large;
- the coder 1 works at high resolution.

Under these assumptions and by applying the central limit theorem, the power $P_e^m(s, i)$ of the quantization error, in a sub-band s and for a signal $S_i$, tends, as the number of coefficients in a band s increases, toward a Gaussian whose mean $m_{P_e^m(s,S_i)}$ and variance $\sigma_{P_e^m(s,S_i)}$ are given by the following formulae:

$$\begin{cases} m_{P_e^m(s,j)} = \sum_{k=k_{min,s}}^{k_{max,s}} E[e_i^m(k)^2 \\ \sigma^2_{P_e^m(s,i)} = \sum_{k=k_{min,s}}^{k_{max,s}} E[e_i^m(k)^4] - E[e_i^m(k)^2]^2 \end{cases}$$

where the function E[x] delivers the mean of the variable x.

The constraint "Probability $(P_e^m(s, i) \le M_T^m(s, i) \ge \alpha$" indicated in formula 2 above may then be written with the aid of the following formula (3):

$$m_{P_e^m(s,i)} + \beta(\alpha)\sigma_{P_e^m(s,i)} \le M_T^m(s, i)$$

With: $\beta(\alpha) = \sqrt{2}\,\mathrm{Erf}^{-1}(2\alpha - 1)$ and the function $\mathrm{Erf}^{-1}(x)$ is the inverse of the Euler error function.

The variables $e_i^m(k)$ being independent according to the index i, it therefore follows that:

$$E[e_i^m(k)^2] = \sum_{j=1}^{r} h_{i,j}^2 E[v_i^m(k)^2]$$

Consequently, we obtain:

$$m_{P_e^m(s,i)} = \sum_{k=k_{min,s}}^{k_{max,s}} \sum_{j=1}^{r} h_{i,j}^2 E[v_i^m(k)^2] = \sum_{j=1}^{r} h_{i,j}^2 \sum_{k=k_{min,s}}^{k_{max,s}} E[v_j^m(k)^2]$$

The random variables $e_i^m(k)$ being independent and equi-distributed according to the index k, the random variables $v_i^m(k)$ are also independent and equi-distributed according to the index k. Consequently:

$$m_{P_e^m(s,i)} = K_s \cdot \sum_{j=1}^{r} h_{i,j}^2 E[(v_i^m(s))^2]$$

with:

$$K_s = k_{max,s} - k_{min,s} + 1$$

It is assumed that the quantization error powers $P_e^m(s, i)$ tend to Gaussians, thus:

$$E[e_i^m(k)^4]=3E[e_i^m(k)^2]^2$$

Hence:

$$\sigma^2_{P_e^m(s,i)} = 2\sum_{k=k_{min,s}}^{k_{max,s}} E[e_i^m(k)^2]^2$$

Thus we can write:

$$\sigma^2_{P_e^m(s,i)} = 2\sum_{k=k_{min,s}}^{k_{max,s}} \left(h_{i,j}^2 \sum_{j=1}^{r} E[v_j^m(k)^2]\right)^2$$

On the basis of the latter equation, and by applying the Cauchy-Schwartz inequality:

$$\sigma_{P_e^m(s,i)} = \sqrt{2}\sqrt{\sum_{k=k_{min,s}}^{k_{max,s}} \left(h_{i,j}^2 \sum_{j=1}^{r} E[v_j^m(k)^2]\right)^2} \le \sqrt{2}\sum_{k=k_{min,s}}^{k_{max,s}} h_{i,j}^2 \sum_{j=1}^{r} E[v_j^m(k)^2]$$

Which implies that:

$$\sigma_{P_e^M(s,i)} \le \sqrt{2}\, m_{P_e^m(s,i)}$$

Moreover, at high resolution:

$$E[v_j^2] \approx \frac{16}{9} E[e_R^2] B_j^m(s)^{\frac{3}{2}} \mu_{\frac{1}{2},j}(s)$$

with $$\mu_{\frac{1}{2},j}$$

representing the mathematical expectation of $$|Y_j^m|^{\frac{1}{2}}$$

in the sub-band s processed and $e_R$ the rounding error specific to the rounding function Arr.

If Arr(x) is for example the function providing the integer nearest to the variable x, $e_R$ is equal to 0.5. If Arr(x) is the "integer part" function of the variable x, $e_R$ is equal to 1.

Thus the constraint given by formula (3) relating to the signal $S_i$, i=1 to N, on a band s, may be written in the following form:

$$K_s \frac{16}{9} E[e_R^2](1+\sqrt{2}\,\beta(\alpha)) \sum_{j=1}^{r} \left(h_{i,j}^2 B_j^m(s)^{\frac{3}{2}} \mu_{\frac{1}{2},j}(s)\right) \le M_T^m(s, i)$$

It is thus possible, on the basis of the latter equation, to determine whether scale coefficients $(B_j^m(s))_{1\le j\le r}$ computed by the quantization module 4 to code the components of the transform, do or do not make it possible to comply with the masking threshold such as considered in the domain of the signal.

The latter equation represents a sufficient condition for the noise corresponding to channel i to be masked at output in the listening domain.

In one embodiment of the invention, the quantization module 4 is adapted for determining with the aid of the latter equation, for a current block m of frames, scale coefficients $(B_j^m(s))_{1\le j\le r}$ guaranteeing that the noise in the listening domain is masked.

In a particular embodiment of the invention, the quantization module 4 is adapted for determining, for a current block m of frames, scale coefficients $(B_j^m(s)_{1\le j\le r}$ guaranteeing that the noise in the listening domain is masked and furthermore making it possible to comply with a bit rate constraint.

In one embodiment, the conditions to be complied with are the following:

Minimize the overall bit rate $$D^m = \sum_{j=1}^{r} D_j^m$$

Under the constraint:

$$K_s \frac{16}{9} E[e_R^2](1+\sqrt{2}\,\beta(\alpha)) \sum_{j=1}^{r} \left(h_{i,j}^2 B_j^m(s)^{\frac{3}{2}} \mu_{\frac{1}{2},j}(s)\right) \le M_T^m(s, i)$$

for any band s, with $D_j^m$ the overall bit rate ascribed to the ambisonic component $Y_j$.

We may thus write that:

$$D_j^m = \sum_s D_j^m(s)$$

where $D_j^m(s)$ is the bit rate ascribed to the ambisonic component $Y_j$ in the band s.

Minimizing the overall bit rate $D^m$ therefore amounts to minimizing the bit rate $$D^m(s) = \sum_{j=1}^{r} D_j^m(s)$$

in each band s. In a first approximation, it is possible to write that the bit rate ascribed to an ambisonic component in a band s is a logarithmic function of the scale coefficient, i.e.:

$$D_j^m(s)=D_{j,0}^m-\gamma\, ln(B_j^m(s))$$

The new function to be minimized may therefore be written in the following form:

$$F(s) = -\sum_{j=1}^{r} \ln(B_j^m(s))$$

To solve the band-wise quantization problem by minimizing the overall bit rate under the constraint (3), it is therefore necessary to minimize the function F under the constraint (3).

This constrained optimization problem is for example solved with the aid of the method of Lagrangians. The Lagrangian function may be written in the following form:

$$L(B,\lambda) = -\sum_{j=1}^{r} \ln(B_j^m(s)) + \sum_{i=1}^{N} \lambda_i \left[ K_s \frac{16}{9} E[e_R^2](1+\sqrt{2}\,\beta(\alpha)) \sum_{j=1}^{r} \left( h_{i,j}^2 B_j^m(s)^{\frac{3}{2}} \mu_{\frac{1}{2},j}(s) \right) - M_T^m(s,i) \right]$$

$$\left( L(B,\lambda) = -\sum_{j=1}^{r} \ln(B_j^m(s)) + \Delta_j^m(\lambda) B_j^m(s)^{\frac{3}{2}} - \sum_{i=1}^{N} \lambda_i M_T^m(s,i) \right)$$

With:

$$\Delta_j^m(\lambda) = \mu_{\frac{1}{2},j}(s) K_s \frac{16}{9} E[e_R^2](1+\sqrt{2}\,\beta(\alpha)) \sum_{i=1}^{N} h_{i,j}^2 \lambda_i$$

and the values $\lambda_j$, $1 \le j \le N$, are the coordinates of the Lagrange vector $\lambda$.

The implementation of the method of Lagrangians makes it possible to write first of all that, for $1 \le j \le r$:

$$B_j^m(s) = \frac{3}{2} \frac{1}{\Delta_j^m(\lambda)}$$

The scale coefficients are replaced with these terms in the Lagrange equation. And one then seeks to determine the value of the Lagrange vector $\lambda$ which maximizes the function $\omega(\lambda) = L((B_1^m(s), \ldots, B_r^m(s)), \lambda)$, for example with the aid of the gradient method for the function $\omega$.

According to the gradient procedure of Uzawa $\nabla w(\lambda)$, where $$\nabla \omega(\lambda) = \begin{pmatrix} \frac{\partial \omega}{\partial \lambda_1}(\lambda) \\ \vdots \\ \frac{\partial \omega}{\partial \lambda_N}(\lambda) \end{pmatrix}$$

the partial derivatives are none other than the constraints computed for the $$B_j^m(s) = \frac{3}{2} \frac{1}{\Delta_j^m(\lambda)}.$$

The relative gradient iterative procedure (cf. in particular the Derrien document) is used to solve this system.

The general equation (formula (4)) for updating the Lagrange vector during a $(k+1)^{th}$ iteration of the procedure may then be written in the following form:

$$\lambda^{k+1} = \lambda^k \otimes (1 + \rho m \otimes \nabla \omega(\lambda^k))$$

with the Lagrange vector $\lambda$ with an exponent (k+1) indicating the updated vector and the Lagrange vector $\lambda$ with an exponent k indicating the vector computed previously during the $k^{th}$ iteration, $\otimes$ designating the term by term product of two vectors of the same size, $\rho$ designating the stepsize of the iterative algorithm and m being a weighting vector.

In one embodiment, so as to ensure the convergence of the iterative procedure, the vector m is chosen equal to:

$$\begin{pmatrix} \frac{1}{M_T^m(s,1)} \\ \vdots \\ \frac{1}{M_T^m(s,N)} \end{pmatrix}$$

Figure 3:
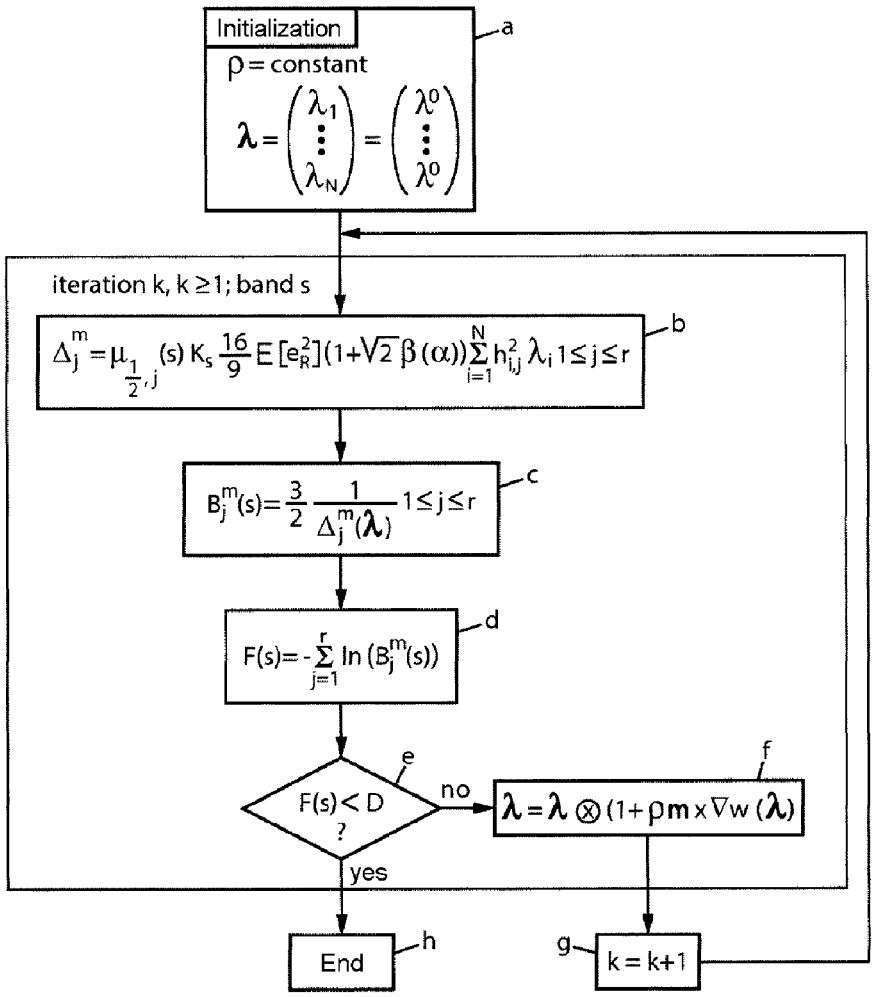
FIG. 3 is a flowchart representing steps of a method in an embodiment of the invention.

In the embodiment considered, the quantization module 4 is adapted for implementing the steps of the method described below with reference to FIG. 3 on each quantization band s during the quantization of a block m of signals $(S_i)_{1 \le i \le N}$.

The method is based on an iterative algorithm comprising instructions for implementing the steps described below during the execution of the algorithm on computation means of the quantization module 4.

In a step a/ of initialization (k=0), the following are defined: the value of the iteration stepsize $\rho$, a value D representing a bit rate threshold and the value of the coordinates $(\lambda_1, \ldots \lambda_N)$ of the initial Lagrange vector with $\lambda_j = \lambda^0$, $1 \le j \le N$.

The steps of the iterative loop for a $(k+1)^{th}$ iteration, with k an integer greater than or equal to 0, are as follows.

In a step b/, the values of the Lagrange vector coordinates $\lambda_j$, $1 \le j \le N$ considered being those computed previously during the $k^{th}$ iteration, the following is computed for $1 \le j \le N$:

$$\Delta_j^m(\lambda) = \mu_{\frac{1}{2},j}(s) K_s \frac{16}{9} E[e_R^2](1+\sqrt{2}\,\beta(\alpha)) \sum_{i=1}^{N} h_{i,j}^2 \lambda_i$$

Then, in a step c/, the scale coefficients are computed, for $1 \le j \le r$:

$$B_j^m(s) = \frac{3}{2} \frac{1}{\Delta_j^m(\lambda)}$$

In a step d/, the value of the function F is computed on the band s, representing the corresponding bit rate for the band s:

$$F(s) = -\sum_{j=1}^{r} \ln(B_j^m(s))$$

In a step e/, the value F(s) computed is compared with the given threshold D.

If the value F(s) computed is greater than the given threshold D, the value of the Lagrange vector $\lambda$ for the $(k+1)^{th}$ iteration is computed in a step f/ with the aid of equation (4) indicated above and of the Lagrange vector computed during the $k^{th}$ iteration.

Then, in a step g/, the index k is incremented by one unit and steps b/, c/, d/ and e/ are repeated.

If the value F(s) computed in step e/ is less than the given threshold D, the iterations are halted. Scale coefficients $(B_j^m(s))_{1 \le j \le r}$ have thus been determined for the quantization band s making it possible to mask, in the listening domain, the noise due to the quantization in the band s, of the ambisonic components $(Y_j)_{1 \le j \le r}$, while guaranteeing that the bit rate required for this quantization in the band s is less than a determined value, dependent on D.

The quantization function thus determined for the respective bands s and respective ambisonic components is thereafter applied to the spectral coefficients of the ambisonic components. The quantization indices as well as elements for defining the quantization function are provided to the Huffman coding module 5.

The coding data delivered by the Huffman coding module 5 are thereafter transmitted in the form of a binary stream Φ to the decoder 100.

Operations Carried Out at the Decoder Level:

The binary sequence reading module 101 is adapted for extracting coding data present in the stream Φ received by the decoder and deducing therefrom, in each band s, quantization indices i(k) and scale coefficients $(B_j^m(s))_{1 \le j \le r}$.

The inverse quantization module 102 is adapted for determining the spectral coefficients, relating to the band s, of the corresponding ambisonic components as a function of the quantization indices i(k) and scale coefficients $(B_j^m(s))_{1 \le j \le r}$ in each band s.

Thus a spectral coefficient $Y_{j,t}$ relating to the frequency $F_t$ element of the band s of the ambisonic component $Y_j$ and represented by the quantization index i(k) is reconstructed by the inverse quantization module 102 with the aid of the following formula:

$$Y_{j,t} = A_j^m(s) i(k)^{\frac{4}{3}}$$

An ambisonic decoding is thereafter applied to the r decoded ambisonic components, so as to determine Q' signals $S'_1, S'_2, S'_{Q'}$ intended for the Q' loudspeakers H1, H2 . . . , HQ'.

The quantization noise at the output of the decoder 100 is a constant which depends only on the transform R used and on the quantization module 4 since the psychoacoustic data used during coding do not take into consideration the processings performed during reconstruction by the decoder. Indeed, the psychoacoustic model does not take into account the acoustic interactions between the various signals, but computes the masking curve for a signal as if it was the only signal listened to. The computed error in this signal therefore remains constant and masked for any ambisonic decoding matrix used. This ambisonic decoding matrix will simply modify the distribution of the error on the various loudspeakers at output.

What is claimed is:

1. A method for quantizing components, the method comprising:

determining each of at least some of said components as a function of a plurality of audio signals of a sound scene by applying a multichannel linear transformation to said audio signals, wherein a quantization function applied to said components in a given frequency band is determined by testing a condition relating to at least one audio signal and depending at least on a comparison performed between:

a psychoacoustic masking threshold relating to the audio signal in the given frequency band, and a value determined as a function of an inverse multichannel linear transformation and of errors of quantization of the components by said function on the given frequency band.

2. The method as claimed in claim 1, wherein the condition relates to several audio signals and depends on several comparisons, each comparison being performed between a psychoacoustic masking threshold relating to a respective audio signal in the given frequency band, and a value determined as a function of the inverse multichannel linear transformation and of errors of quantization of the components by said function.

3. The method as claimed in claim 1, wherein the determination of the quantization function is repeated during the updating of the values of the components to be quantized.

4. The method as claimed in claim 1, wherein the condition relating to an audio signal at least is tested by comparing the psychoacoustic masking threshold relating to the audio signal and an element representing the mathematical value $$\sum_{j=1}^{r} \left( h_{i,j}^2 B_j(s)^{\frac{3}{2}} \mu_{\frac{1}{2},j}(s) \right),$$

where:

s is the given band of frequencies, r is the number of components, $h_{i,j}$ is that coefficient of the inverse multichannel linear transform relating to the audio signal and to the $j^{th}$ component with j=1 to r, $B_j(s)$ represents a parameter characterizing the quantization function in the band s relating to the $j^{th}$ component, and $\mu 1^{2}$,j(s) is the mathematical expectation in the band s of the square root of the $j^{th}$ component.

5. The method as claimed in claim 1, wherein a quantization function applied to said components in the given frequency band comprises:

determining, with the aid of an iterative process generating, at each iteration, a parameter of the candidate quantization function satisfying the condition and associated with a corresponding bit rate, and halting the iteration when the bit rate is below a given threshold.

6. The method as claimed in claim 1, wherein the multichannel linear transformation is an ambisonic transformation.

7. A hardware quantization module that quantizes at least components each determined as a function of a plurality of audio signals of a sound scene and computable by applying a multichannel linear transformation to said audio signals, said hardware quantization module being adapted to:

determine each of at least some of said components as a function of a plurality of audio signals of a sound scene by applying a multichannel linear transformation to said audio signals, wherein a quantization function applied to said components in a given frequency band is determined by testing a condition relating to at least one audio signal and depending at least on a comparison performed between:

a psychoacoustic masking threshold relating to the audio signal in the given frequency band, and a value determined as a function of an inverse multichannel linear transformation and of errors of quantization of the components by said function on the given frequency band.

8. An audio coder that codes an audio scene comprising several respective audio signals as a binary output stream, comprising:

a hardware transformation module that computes, by applying a multichannel linear transformation to said audio signals, components at least some of which are each determined as a function of a plurality of the audio signals; and a hardware quantization module as claimed in claim 7 that determines at least one quantization function on at least one given frequency band and for quantizing the components on the given frequency band as a function of at least the determined quantization function;

said coder being adapted for constructing a binary stream as a function at least of quantization data delivered by the hardware quantization module.

9. A non-transitory computer readable medium comprising computer instructions for execution on a processor that are to be installed in a quantization module, said instructions for implementing a method, the method comprising:

determining each of at least some of said components as a function of a plurality of audio signals of a sound scene by applying a multichannel linear transformation to said audio signals, wherein a quantization function applied to said components in a given frequency band is determined by testing a condition relating to at least one audio signal and depending at least on a comparison performed between:

a psychoacoustic masking threshold relating to the audio signal in the given frequency band, and a value determined as a function of an inverse multichannel linear transformation and of errors of quantization of the components by said function on the given frequency band.

10. Coded data, determined following the implementation of a quantization method, the method comprising:

determining each of at least some of said components as a function of a plurality of audio signals of a sound scene by applying a multichannel linear transformation to said audio signals, wherein a quantization function applied to said components in a given frequency band is determined by testing a condition relating to at least one audio signal and depending at least on a comparison performed between:

a psychoacoustic masking threshold relating to the audio signal in the given frequency band, and a value determined as a function of an inverse multichannel linear transformation and of errors of quantization of the components by said function on the given frequency band.

* * * * *